US008083566B2

(12) United States Patent
Finlan

(10) Patent No.: US 8,083,566 B2
(45) Date of Patent: Dec. 27, 2011

(54) SPINNING TOY TOP CONTROLLED BY REPELLING MAGNETIC CONTROLLER

(76) Inventor: Ryan Michael Finlan, Thousand Oaks, CA (US)

( * ) Notice: Subject to any disclaimer, the term of this patent is extended or adjusted under 35 U.S.C. 154(b) by 137 days.

(21) Appl. No.: 12/606,419

(22) Filed: Oct. 27, 2009

(65) Prior Publication Data

US 2011/0097965 A1 Apr. 28, 2011

(51) Int. Cl.
*A63H 1/00* (2006.01)

(52) U.S. Cl. ..... 446/259; 446/132; 446/133

(58) Field of Classification Search ..... 446/259, 446/133, 132
See application file for complete search history.

(56) References Cited

U.S. PATENT DOCUMENTS

| | | | | |
|---|---|---|---|---|
| 3,224,142 | A * | 12/1965 | Pawelka et al. | 446/259 |
| 3,583,092 | A * | 6/1971 | Schoenfield | 446/241 |
| 6,443,801 | B1 * | 9/2002 | Bell | 446/256 |
| 6,739,939 | B2 * | 5/2004 | Matsukawa | 446/259 |
| 2010/0159798 | A1 * | 6/2010 | Bertrand et al. | 446/259 |

* cited by examiner

*Primary Examiner* — Gene Kim
*Assistant Examiner* — Urszula M Cegielnik
(74) *Attorney, Agent, or Firm* — Sinorica, LLC

(57) ABSTRACT

A toy top which encases a plurality of repelled magnets and a magnetic controller which encases a controlling magnet. The repelled magnets in the top direct a magnetic field away from their embodiment with an opposing polarity to the magnetic field directed by the magnetic controller and away from its embodiment. Contact of the two opposing magnetic fields results in a magnetic force which repels the top away from the magnetic controller while the top is spinning. The top is put into a rotational spin by pulling a rip cord through a handle and turning a spinning gear fit into the top's gear fitting.

13 Claims, 2 Drawing Sheets

SPINNING TOY TOP CONTROLLED BY REPELLING MAGNETIC CONTROLLER

FIELD OF INVENTION

This invention relates generally to a toy top that is put into rotational movement through the use of a turning gear powered by pulling a rip cord. Specifically, the toy top of the invention is directionally maneuvered while in rotational movement by using opposing magnetic fields.

BACKGROUND OF THE INVENTION

Traditional toy tops are generally used in recreation by spinning the top and watching its rotational and gyroscopic movement along with its eventual collapse. This invention overcomes the traditional and simplistic model of only watching the top by allowing the user to interact with the top while it is spinning. Being able to maneuver the top introduces many possible new aspects of play including but not limited to colliding several spinning tops together.

SUMMARY OF THE INVENTION

The toy of the present invention includes a top having an egg-shaped body, a magnetic controller with an arched controller-body surface, a top-handle of rectangular shape, a spinning gear, a rip cord with gear-teeth, at least one controlling magnet, and at least one repelled magnet. The top has a balancing tip that is inversely conical, and a gear fitting fixed in the center at the topmost point of the top. The at least one repelled magnet is positioned and enclosed within the top with the repelled magnets fixed inside a magnet encasement. On the exterior of the top, a reinforcing band wraps the circumference of the top with view holes positioned on the reinforcing band. The magnetic controller houses a at least one controlling magnet which directs a magnetic field of opposite polarity than the field directed outwards by the at least one repelled magnet. The top is put into a rotational movement through the use of a top-handle with a spinning gear and powered by pulling a rip cord through the top-handle. The top is then maneuvered by allowing the magnetic field of the magnetic controller to contact the magnetic field of the at least one repelled magnet.

DETAIL DESCRIPTIONS OF THE INVENTION

Figure 1:
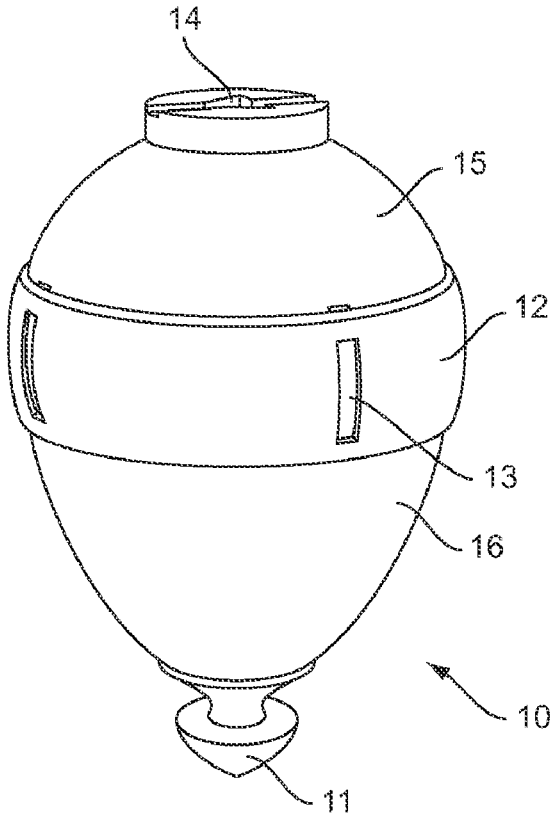
FIG. 1 is a perspective view of the toy top in accordance with the present invention.

Terminology and Lexicography:

Top: a toy which is used in recreational play that is often inversely conical or egg-shaped, with a balancing tip on which it balances and spins in rotational movement.

A spinning toy top controlled by repelling magnetic controller comprises of a main body 10, a balancing tip 11, a reinforcing band 12, a plurality of view holes 13, a gear fitting 14, a top-half body 15, a lower-half body 16, a controller body 20, a plurality of controller view holes 21, at least one controlling magnet 22, a magnet fitting space 23, a top-handle 30, a rip cord handle 31, a rip cord 32, a spinning gear 33, a plurality of gear-teeth 34, a plurality of repelled magnets 40, a plurality of magnet encasements 41, and a hollow space 42.

In reference to FIG. 1, the top has a main body 10 with a structural shape of an inverse egg and is constructed of non-magnetically attractive materials. The main body 10 comprises of a top-half body 15 and a lower-half body 16 which are engaged and connected with a reinforcing band 12. The main body 10 forms a hollow space 42 within the main body 10 of the top. The reinforcing band 12 is rectangular in shape and wraps around the outer circumference of the main body 10 where the main body 10 has the greatest thickness. On the reinforcing band 12 and extending past and through the main body 10, a plurality of view holes 13 allow a user of the invention to look inside the main body 10 and view an enclosing plurality of repelled magnets 40. A balancing tip 11 of inversely-conical shape is positioned on the bottom-most point of the top. A gear fitting 14 of triangular shaped hole is fixed in the center at the topmost point of the top.

Figure 4:
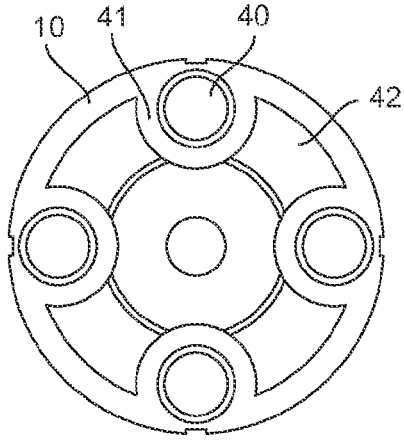
FIG. 4 is a top plan view of the toy top as shown in FIG. 1 wherein the toy top is horizontally cut into two segments and viewing only the bottom segment thereof.

In reference to FIG. 4, a plurality of magnet encasements 41 is positioned at equal distance from each other along the inner circumference of the top's main body 10. Each of the magnet encasements 41 have a cavity space equal to the volume of a repelled magnet 40 and subsequently contain one repelled-magnet 40. Each of the repelled magnets 40 are positioned with a magnetic field of the same polarity facing towards the inner wall of the main body 10 and away from the center of the embodiment. This configuration is of the preferred embodiment although the plurality of repelled-magnets 40 can take the form of non-cylindrical shapes, or exist as a singular magnet such as a donut-shape, given that the magnet or magnets are uniformly distributed around the inner perimeter of the main body 10.

Figure 2:
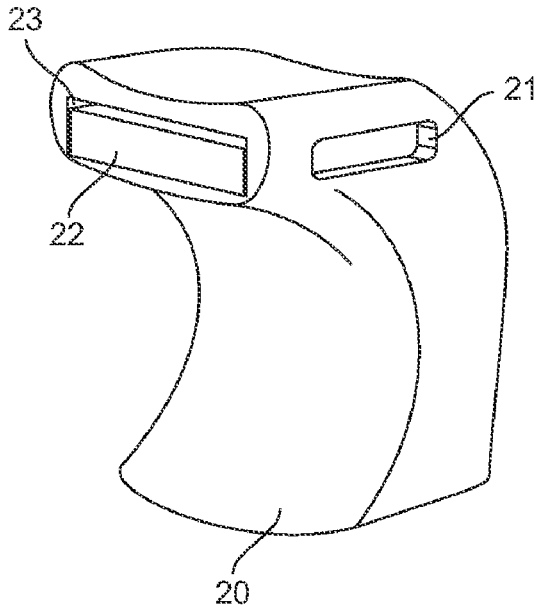
FIG. 2 is a perspective view of the magnetic controller in accordance with the present invention.

In reference to FIG. 2, the magnetic controller comprises of a controller body 20 with at least one controlling magnet 22, wherein the at least one controlling magnet 22 can be viewed from a side angle through two controller view holes 21. The controller body 20 has the shape of a rectangular block with smoothed edges wherein the front surface is depressed inward to create an arc, with arc ends at the base and at the top of the controller body 20. The inwardly depressed arc of the controller body 20 provides easy grip of said controller body 20. At the top of the controller body 20, a magnet fitting space 23 of rectangular cavity space exists with an opening to the magnet fitting space 23 at the front of the controller body 20 and above the top end of the front surface arc depression. The magnet fitting space 23 has a space volume equal to the volume of the at least one controlling magnet 22. The at least one controlling magnet 22 is fixated inside the magnet fitting space 23 on the controller body 20 with an edge of the at least one controlling magnet 22 facing the front, exposed and visible by the opening of the magnet fitting space 23. The polarity of the front-facing edge of the at least one controlling magnet 22 is of opposite polarity from the plurality of repelled magnets that are facing away from the center of their embodiment. Both the magnet fitting space 23 and its enclosed at least one controlling magnet 22 are level parallel to the base surface of the magnetic controller. Two controller view holes 21 are located on the magnetic controller with one view hole 21 on the left side and one view hole 21 on the right side of the front surface, where the front surface is the surface of the magnetic controller having the depressed arc. The two view holes 21 are positioned on the controller body 20 so that they expose the at least one controlling magnet 22 from the left and right sides of the magnetic controller.

Figure 3:
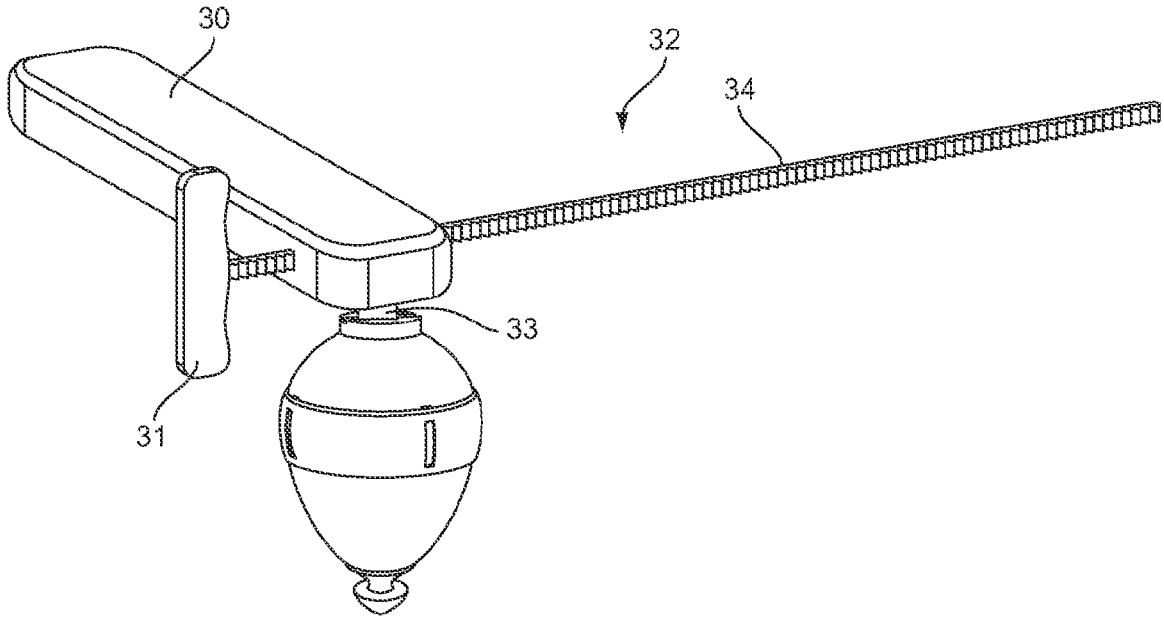
FIG. 3 is a perspective view showing the top-handle and rip cord in accordance with the present invention.

In reference to FIG. 3, a top-handle 30 has the shape of a rectangular prism block with smoothed edges. A hole passes through the top-handle 30 at one end, allowing a rip cord 32 to be inserted through the top-handle 30. A rip cord handle 31 at one end of the rip cord 32 allows a user to grip the rip cord handle 31 and pull the rip cord 32 through the hole positioned on the handle 30. A spinning gear 33 is partially inside the top-handle 30 and partially protruding downward to the outside of the top-handle 30. The portion of the spinning gear 33 inside the top-handle 30 has a plurality of gear-teeth 34 which engage with the gear-teeth 34 of the rip cord when it is placed inside the hole of the top-handle 30. When the rip cord handle 31 is pulled, the rip cord 32 drives the spinning gear 33 through the engagement of the rip cord 32 and the spinning gear 33. The spinning gear 33 is fit into the top's gear fitting 14 so that as the spinning gear 33 rotates, the top is subsequently put into a spinning rotational movement through the engagement of the spinning gear 33 and the gear fitting 14.

During play, the top is spun and a user can maneuver the directional movement of the top while it is spinning by using the magnetic controller. The plurality of repelled magnets 40 of the top and the at least one controlling magnet 22 of the magnetic controller have an opposite magnetic polarity directed away from their embodiment. When a user holding the magnetic controller moves it towards the top, the magnetic field of the controlling magnet 22 contacts the magnetic fields of the plurality of repelled magnets 40. When these two opposing magnetic fields come into contact, the resulting magnetic force repels the top away from the magnetic controller. To effectively maneuver the top, relative heights of the repelled magnets 40 and the at least one controlling magnet 22 are important. The positional height of each of the plurality of repelled magnets 40 and the at least one controlling magnet 22 is measured from the bottom-most point of their respective embodiments. The positional height of the plurality of repelled magnets 40 is equal to the positional height of the at least one controlling magnet 22 so that their magnetic forces, when in contact, repel directly horizontal without angulations. In addition, the top and magnetic controller interacts on a level surface where the magnetic controller slides along this level surface to maintain the positional heights of the plurality of repelled magnets 40 and the at least one controlling magnet 22. This configuration is of the preferred embodiment although the positional heights of the plurality of repelled magnets 40 and the at least one controlling magnet 22 may be different to allow angular repelling magnetic forces resulting in different effects to the movement of the top. The use of magnetic force to maneuver the top allows the top to maintain the speed of its rotational movement and stay balanced. A physical object making contact with the top in order to maneuver the top would result in friction between the object used and the top, reducing the top's rotational speed. In the present invention, the magnetic controller uses magnetic forces to maneuver the top without making physical contact to the top itself. As a result, friction and reduction of the top's rotational speed, if any, is minimized.

Although the invention has been explained in relation to its preferred embodiment, it is to be understood that many other possible modifications and variations can be made without departing from the spirit and scope of the invention as hereinafter claimed.

What is claimed is:

1. A toy top controlled by a repelling controller comprises, a main body;

at least one repelled magnet enclosed inside of the main body;

a balancing tip;

a reinforcing band;

a gear fitting;

a top-handle;

a rip cord;

a rip cord handle;

the gear fitting being fixed at one end of the main body;

the balancing tip being fixed at another end of the main body;

the at least one repelled magnet being positioned with a magnetic field of a magnetic polarity facing towards an interior wall of the main body;

the repelling controller comprising a controller body and at least one controlling magnet enclosed inside of the controller body;

a magnetic polarity of the at least one controlling magnet being opposite from the magnetic polarity of the at least one repelled magnet; and a positional height of the at least one repelled magnet measured from a bottom-most point of the toy top being equal to a positional height of the at least one controlling magnet measured from a bottom-most point of the repelling controller.

2. The toy top controlled by a repelling controller as claimed in claim 1 comprises, the main body comprises a top-half body and a lower-half body;

the top-half body and the lower-half body are engaged and connected with the reinforcing band;

the gear fitting is fixed at the top of the top-half body, wherein one end of the spinning gear engages and fits into the gear fitting;

a hollow space is formed within the main body, wherein the at least one repelled magnet is enclosed;

each of the at least one repelled magnet is positioned with a same magnetic-polarity facing to an interior wall of the main body;

each of the at least one repelled magnet is positioned at an equal distance interval along with a circumference of the inner wall of the main body;

each of the at least one repelled magnet is positioned at a same height from the balancing tip; and at least one band view hole is positioned on the reinforcing band, wherein the at least one repelled magnet is exposed through the at least one band view hole.

3. The toy top controlled by a repelling controller as claimed in claim 1 comprises, the controller body comprises a flat bottom surface and a magnet fitting space positioned at an opposite end of the flat bottom surface;

the magnet fitting space being extended away from the controller body with an opening at one end of the fitting space;

the at least one controlling magnet is positioned and fixed within the magnet fitting space;

the magnetic polarity, of the at least one controlling magnet, that is facing out of the opening is an opposite magnetic polarity from the interior-wall-facing magnetic polarity of the repelled magnets; and a controller view hole is positioned at each of two sides of the magnet fitting space respectively.

4. The toy top controlled by a repelling controller as claimed in claim 1 comprises, the top-handle comprises a through hole and a spinning gear, wherein the rip cord is inserted through the through hole;

the rip cord comprises a plurality of gear-teeth on a surface of the rip cord;

the spinning gear comprises a plurality of spin-teeth on a surface of the spinning gear;

the gear-teeth engage with the spin-teeth inside of the top-handle; and the rip cord comprises a rip cord handle being fixed at one end of the rip cord.

5. The toy top controlled by a repelling controller as claimed in claim 2 comprises, the controller body comprises a flat bottom surface and a magnet fitting space positioned at an opposite end of the flat bottom surface;

the magnet fitting space being extended away from the controller body with an opening at one end of the fitting space;

the at least one controlling magnet is positioned and fixed within the magnet fitting space;

the magnetic polarity, of the at least one controlling magnet, that is facing out of the opening is an opposite magnetic polarity from the interior-wall-facing magnetic polarity of the repelled magnets; and a controller view hole is positioned at each of two sides of the magnet fitting space respectively.

6. The toy top controlled by a repelling controller as claimed in claim 3 comprises, the top-handle comprises a through hole and a spinning gear, wherein the rip cord is inserted through the through hole;

the rip cord comprises a plurality of gear-teeth on a surface of the rip cord;

the spinning gear comprises a plurality of spin-teeth on a surface of the spinning gear;

the gear-teeth engage with the spin-teeth inside of the top-handle; and the rip cord comprises a rip cord handle being fixed at one end of the rip cord.

7. The toy top controlled by a repelling controller as claimed in claim 4 comprises, the main body comprises a top-half body and a lower-half body;

the top-half body and the lower-half body are engaged and connected with the reinforcing band;

the gear fitting is fixed at the top of the top-half body, wherein one end of the spinning gear engages and fits into the gear fitting;

a hollow space is formed within the main body, wherein the at least one repelled magnet is enclosed;

each of the at least one repelled magnet is positioned with a same magnetic-polarity facing to an interior wall of the main body;

each of the at least one repelled magnet is positioned at an equal distance interval along with a circumference of the inner wall of the main body;

each of the at least one repelled magnet is positioned at a same height from the balancing tip; and at least one band view hole is positioned on the reinforcing band, wherein the at least one repelled magnet is exposed through the at least one band view hole.

8. The toy top controlled by a repelling controller as claimed in claim 5 comprises, the top-handle comprises a through hole and a spinning gear, wherein the rip cord is inserted through the through hole;

the rip cord comprises a plurality of gear-teeth on a surface of the rip cord;

the spinning gear comprises a plurality of spin-teeth on a surface of the spinning gear;

the gear-teeth engage with the spin-teeth inside of the top-handle; and the rip cord comprises a rip cord handle being fixed at one end of the rip cord.

9. The toy top controlled by a repelling controller as claimed in claim 6 comprises, the main body comprises a top-half body and a lower-half body;

the top-half body and the lower-half body are engaged and connected with the reinforcing band;

the gear fitting is fixed at the top of the top-half body, wherein one end of the spinning gear engages and fits into the gear fitting;

a hollow space is formed within the main body, wherein the at least one repelled magnet is enclosed;

each of the at least one repelled magnet is positioned with a same magnetic-polarity facing to an interior wall of the main body;

each of the at least one repelled magnet is positioned at an equal distance interval along with a circumference of the inner wall of the main body;

each of the at least one repelled magnet is positioned at a same height from the balancing tip; and at least one band view hole is positioned on the reinforcing band, wherein the at least one repelled magnet is exposed through the at least one band view hole.

10. The toy top controlled by a repelling controller as claimed in claim 7 comprises, the controller body comprises a flat bottom surface and a magnet fitting space positioned at an opposite end of the flat bottom surface;

the magnet fitting space being extended away from the controller body with an opening at one end of the fitting space;

the at least one controlling magnet is positioned and fixed within the magnet fitting space;

the magnetic polarity, of the at least one controlling magnet, that is facing out of the opening is an opposite magnetic polarity from the interior-wall-facing magnetic polarity of the repelled magnets; and a controller view hole is positioned at each of two sides of the magnet fitting space respectively.

11. The toy top controlled by a repelling controller as claimed in claim 8 comprises, a plurality of magnet encasements being positioned and enclosed within the hollow space; and each of the at least one repelled magnet is positioned and enclosed within one of the at least one magnet encasement.

12. The toy top controlled by a repelling controller as claimed in claim 9 comprises, a plurality of magnet encasements being positioned and enclosed within the hollow space; and each of the at least one repelled magnet is positioned and enclosed within one of the at least one magnet encasement.

13. The toy top controlled by a repelling controller as claimed in claim 10 comprises, a plurality of magnet encasements being positioned and enclosed within the hollow space; and each of the at least one repelled magnet is positioned and enclosed within one of the at least one magnet encasement.

* * * * *